United States Patent [19]

Dove

[11] 4,151,083

[45] Apr. 24, 1979

[54] APPARATUS AND METHOD FOR SEPARATING HEAVY IMPURITIES FROM FEED STOCK

[76] Inventor: Norman F. Dove, 555-1155 W. Georgia St., Vancouver, British Columbia, Canada, V6E 3H4

[21] Appl. No.: 880,730

[22] Filed: Feb. 24, 1978

Related U.S. Application Data

[63] Continuation-in-part of Ser. No. 657,414, Apr. 9, 1976, abandoned, which is a continuation of Ser. No. 504,774, Sep. 10, 1974, abandoned.

[51] Int. Cl.[2] ..... B04C 5/103; B04C 5/04

[52] U.S. Cl. ..... 210/84; 209/211; 210/512 M

[58] Field of Search ..... 210/65, 66, 75, 83, 210/84, 207, 209, 511, 512; 209/18, 144, 211

[56] References Cited

U.S. PATENT DOCUMENTS

| | | | |
|---|---|---|---|
| 2,379,411 | 7/1945 | Berges | 210/84 X |
| 2,735,547 | 2/1956 | Vissco | 209/211 |
| 2,878,934 | 3/1959 | Tomlinson | 209/211 |
| 3,313,413 | 4/1967 | Delcellper | 209/211 |
| 3,501,001 | 3/1970 | Muller et al. | 209/211 |
| 3,501,014 | 3/1970 | Fitch, Jr. et al. | 209/211 |
| 3,612,276 | 10/1971 | Lowe | 209/211 |
| 3,754,655 | 8/1973 | Troland | 210/209 |
| 3,802,570 | 4/1974 | Dehne | 210/512 R |
| 3,971,718 | 7/1976 | Reid | 210/512 |

*Primary Examiner*—Theodore A. Granger

*Attorney, Agent, or Firm*—Beveridge, DeGrandi, Kline & Lunsford

[57] ABSTRACT

An apparatus and method are described for separating heavy impurities from feed stock. Feed stock is introduced into a first classifying zone defined by a chamber, usually circular in cross-section. The feed stock is normally liquid being made up of stock suspensions of up to 10% A.D. (air dried) consistency. This feed stock contains heavy impurities in the form of trash such as rocks, sand and the like. The feed stock enters the first zone tangentially where an outer vortex flow is generated. Where the apparatus is intended to pass (and not reject) knots in the feed stock, dilution water may be introduced tangentially in the same direction as the feed stock to control knot rejection. The impurities are subjected to a primary classifying action here, and clarified stock is extracted as central, upwardly rising vortex flow. The impurities form an outer layer which passes from the bottom of the first zone into a second zone. The second zone is defined by a chamber, again usually circular in cross-section, and having a shape which diverges from the exit from the first zone and then converges to a bottom outlet. An inlet introduces a fluid diluent in the second chamber with flow countercurrent to the flow of residual stock and impurities. The diluent, aided by the configuration of the second chamber inhibits vortex flow therein and thus promotes settling out, or separation, of the impurities by gravity. A reject chamber is also provided, preferably having an inlet for further diluent, which back flushes the stock impurities contained therein.

14 Claims, 9 Drawing Figures

18
20
38
39
10
16
32
30
36
12
42
33
14
43
34
44
48
52
50
54
64
68
60
70
66

APPARATUS AND METHOD FOR SEPARATING HEAVY IMPURITIES FROM FEED STOCK

CROSS REFERENCES TO RELATED APPLICATIONS

The present application is a continuation-in-part of application Ser. No. 675,414 filed Apr. 9, 1976, now abandoned which, in turn was a continuation of application Ser. No. 504,774, filed Sept. 10, 1974, now abandoned.

FIELD OF THE INVENTION

This invention relates to a classifying or separating apparatus and method operable for separating heavy impurities from a carrier liquid, particularly a high consistency stock suspension used in paper making. The term "heavy impurities" refers to those impurities having a higher specific gravity than the fibres making up the stock suspension; such impurities may be sand, rocks or metal pieces, and may also be knots where these are required to be removed. The invention provides an improved apparatus and method by which such impurities are removed from papermaking pulp suspensions of up to 10% A.D. (air dried) consistency.

DESCRIPTION OF THE PRIOR ART

The separation of solid matter from liquids, or the separation of different liquids, has been a problem in many industries. Various techniques have been developed over the years to solve these problems, frequently using the effects of gravity and/or centrifugal forces. These techniques have led to the use of centrifugal separators or cleaners, cyclones, and hydro-cyclones. It may be appropriate here for the reader to refer to examples of devices and techniques proposed previously. Thus, the reader is referred to Canadian Pat. Nos. 479,386 issued Dec. 18, 1951, and 532,770 issued on Nov. 6, 1956 to F. J. Fontein; to U.S. Pat. Nos. 2,378,632 of June 19, 1945 (Hooker et al), 2,379,411 of July 3, 1945 (Berges) or 3,052,361 of Sept. 4, 1962 (Whately et al); and to British specification 770,860 of Mar. 27, 1957 (N. V. de Bataafsche Petroleum Maatschappij).

Although various prior art constructions have been tried, not all these have been successful, particularly where the stock consistencies are relatively high, i.e. over 2% A.D. consistency. Also, known apparatus has not always been successful where it is desired to reject heavy solid particles without rejecting knots in papermaking pulp, in cases where the pulp has not previously been deknotted. In some instances operating expenses have been prohibitively high, while on other occasions the rate of rejection of "impurities" has been so great as to include an unacceptably high proportion of desired solid matter, such as the knots, with the rejects. Further refinements have thus been sought continuously.

The present invention provides apparatus which is particularly suitable for separating heavy impurities such as sand, rocks or metal pieces from a high consistency suspension of stock such as is used in paper-making. The invention further provides apparatus capable of separating heavy impurities without rejecting a significant amount of fibres and knots contained within the stock. However, if desired, the apparatus can also be used to separate knots from pulp.

SUMMARY OF THE INVENTION

In accordance with one aspect of the invention there is provided an apparatus for removing heavy impurities from feed stock, comprising a primary classifying chamber having an upper section of circular cross section and a downwardly-converging conical lower section, a central stock outlet pipe extending upwardly through said upper section of the primary chamber and terminating in an end in the lower section thereof spaced a substantial distance from the conical section wall, an outlet in the lower end of the lower section, an inlet pipe for directing feed stock containing heavy impurities tangentially into said chamber upper section to create a vortex flow in the primary chamber, said heavy impurities being separated outwardly by centrifugal force from feed stock being directed to said outlet pipe by centripetal force, said centripetal force being minimal in the upper section and said centrifugal force being maximal in the lower section, a secondary classifying chamber connected to the lower end of said lower conical section to receive the heavy impurities with feed stock therefrom, said secondary classifying chamber having a substantially unobstructed inlet and being formed with an upper section abruptly increasing in diameter directly from said conical lower section of the primary classifying chamber in a downward and lateral direction to a maximum cross sectional area rapidly to reduce the velocity of the vortex flow of the stock and impurities therein, said upper section of the secondary classifying chamber having a substantially greater inclination from the vertical than said conical lower section of the primary classifying chamber said upper section of the secondary classifying chamber lying at an acute angle with respect of the conical lower section of the primary classifying chamber, and a lower conical section of the secondary classifying chamber converging from said maximum cross sectional area to an outlet controlled by a valve, and means for directing a diluent tangentially into the reduced velocity stock in the secondary classifying chamber in a direction counter to the movement of said stock further to dilute the stock to assist separation of the heavy impurities by gravity and to return lighter valuable components of the stock to the primary chamber.

A feature of the invention is that means are provided which normally prevent outflow from the secondary classifying zone, so that there is an upflow of fluid in at least that part of the secondary zone above the inlet for diluent into the secondary zone. A second inlet for diluent may be provided communicating with the secondary zone to augment the upflow of fluid through the secondary zone. This upward flow of diluent helps to return to the primary zone those fibres or knots which pass from the primary zone into the secondary zone, where knot rejection is not required.

The configuration of the upper section of the secondary classifying chamber causes deceleration of flow of residual stock received from the primary classifying zone, thus aiding the countercurrent flow of fluid diluent in the secondary classifying zone to promote gravitational separation of the impurities. In yet a more preferred embodiment of apparatus contemplated herein, the chamber which defines the secondary classifying zone, as well as an additional chamber which defines the primary classifying zone are circular in cross-section.

In still another preferred form of apparatus embodied by this invention there is provided a reject zone for receiving the heavy impurities separated from diluted residual stock in the secondary classifying zone, this reject zone including the above-mentioned second inlet for a fluid diluent further to dilute the rejected impurities and cause a backflushing of sluicing action thereon.

Where the apparatus is required to pass (rather than to reject) knots in a pulp suspension, a further inlet for diluent is provided in the primary zone, arranged to introduce the filtrate with the same rotation as the feed stock.

In a further aspect of the invention the central stock outlet pipe has a downwardly converging conical end section, said downwardly converging end section commencing in said upper section of said primary classifying chamber; and at least one opening formed in said end section.

In yet a further aspect there is provided an apparatus that includes an inlet for directing a diluent tangentially into a lower section of the primary chamber, said inlet being elongated in the direction extending from the upper section to said secondary classifying chamber to permit the introduction of a band of lower consistency stock into said lower section; an inlet for directing a diluent tangentially into the reduced velocity stock in the secondary classifying chamber in a direction counter to the movement of said stock to assist separation of the heavy impurities by gravity and to return lighter valuable components of the stock to the primary chamber and baffles formed on the lower conical section of the secondary classifying chamber to reduce the vortex flow further and to destroy the centrifugal force acting on solid impurities to allow them to roll down the conical section.

In accordance with another apsect of this invention, there is provided a process for separating heavy impurities from feed stock, comprising the steps of introducing feed stock tangentially into a primary zone of circular cross section to create vortex flow in said zone and thereby effect a primary classifying action by centrifugal force on the feed stock, extracting clarified stock subjected to centripetal force in the primary zone from said primary zone centrally thereof, selectively directing a diluent into the primary zone tangentially in the direction of flow of stock therein to dilute and control the consistency of the stock and to separate relatively large but lighter particles from the heavy impurities and directing said particles out with the clarified stock, passing residual stock containing impurities through a substantially unobstructed passage into a secondary zone with a vortex flow, rapidly stopping the vortex flow of the residual stock in the secondary zone by moving the residual stock directly from said secondary zone, across a boundary which forms an acute angle and into a chamber which diverges radially at a substantially greater rate than the vortex flow, directing a diluent into the residual stock in the secondary zone in a direction counter to the movement of said stock to assist further reduction of the vortex flow, and periodically passing stock with the impurities therein out of the secondary chamber and into a reject zone.

These and other features and objects of this invention will become apparent from the following detailed description read in conjunction with the accompanying drawings. These drawings illustrate, by way of example only, one preferred form of apparatus embodied by the invention.

DESCRIPTION OF THE PREFERRED EMBODIMENTS

DESCRIPTION OF THE PREFERRED EMBODIMENTS

Figure 1:
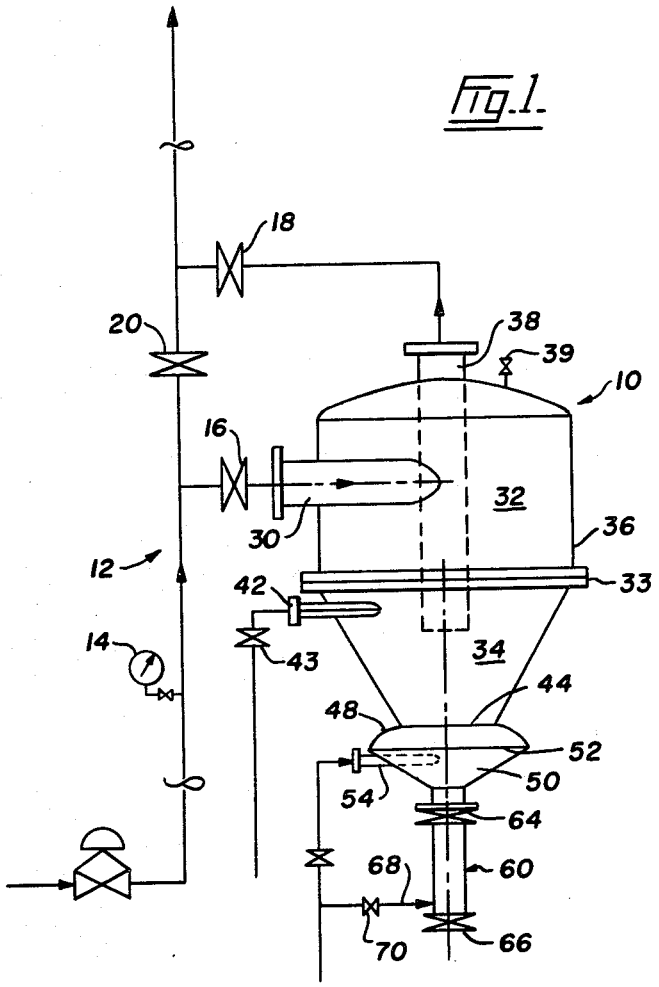
FIG. 1 is a schematic drawing illustrating a fluid circuit in which the present invention can be utilized.

Turning to FIG. 1, a preferred form of separating apparatus embodied by this invention is shown overall at 10. The apparatus 10 is more aptly described as a centrifugal cleaner and will be described by that term in the following description.

The centrifugal cleaner 10 is adapted to be located in a fluid circuit shown overall at 12. In the context in which the centrifugal cleaner 10 is intended normally to be used, the fluid circuit 12 will conduct feed stock in the form of paper-making pulp stock containing the fibres (sometimes including knots) used in the paper-making process as well as stones, pieces of metal and other such heavy impurities. The fluid circuit 12 contains the usual "hardware" associated with controlling and regulating the flow of fluid through that system. Accordingly, there is provided a line pressure gauge 14 and an inlet valve 16, the latter to be used to shut off the flow of feed stock into the centrifugal cleaner 10. Clarified stock that is extracted from the centrifugal cleaner 10 passes through an outlet valve 18, and back to the main stream of fluid circuit 12. A by-pass valve 20 is also provided in the fluid circuit 12 so that the cleaner can be by-passed when shut down for maintenance.

Figure 2:
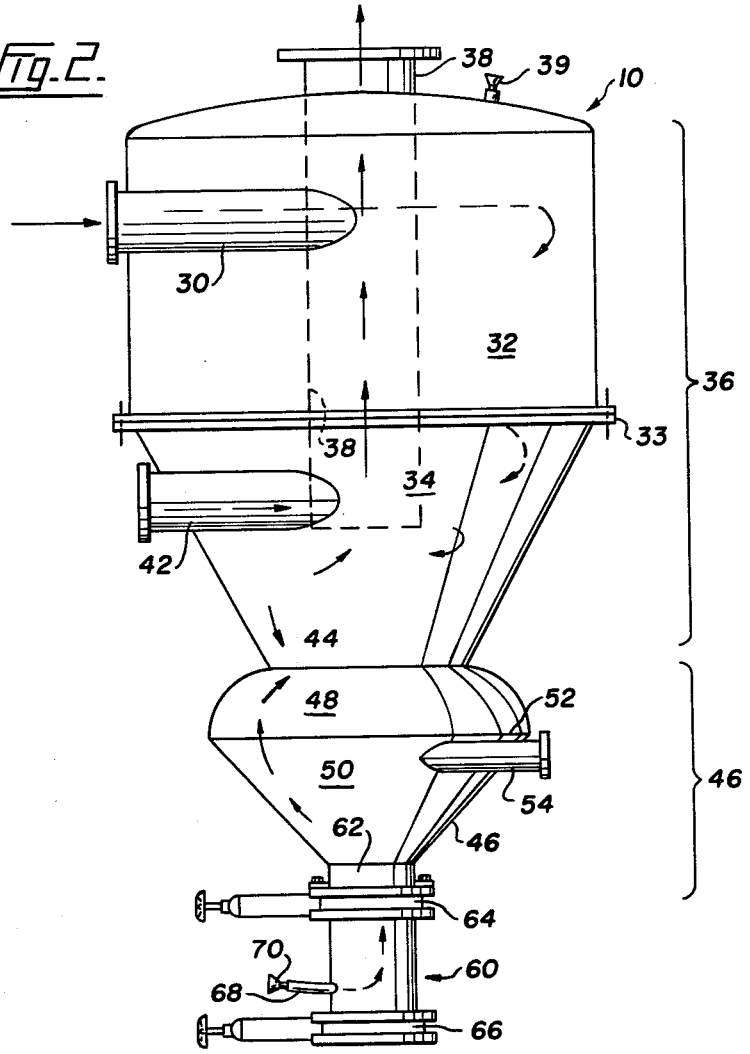
FIG. 2 is an elevation view showing some details of one form of apparatus embodied by this invention.

With particular reference to FIGS. 1 and 2, the centrifugal cleaner 10 comprises an inlet 30 which may, for example, be in the form of a twelve inch pipe located on the downstream or discharge side of the inlet valve 16. The inlet pipe 30 directs or introduces feed stock tangentially into a first portion 32 of a two-part primary classifying chamber 36. The first or upstream portion 32 is connected at a flanged joint 33 to a downwardly converging downstream portion 34 whose cross-sectional area decreases uniformly in the general direction of flow through the cleaner 10. Both the upstream and downstream portions 32 and 34 are usually circular in cross-section. The diameter of the upstream portion 32 can, for example, be of the order of five feet, while the downstream portion 34 connected thereto is in the form of a truncated cone whose base tapers from a diameter equal to the diameter of the upstream portion 32 to a minimum diameter, say, of about two feet. The primary chamber 36 is provided with central outlet or vortex finder 38. This vortex finder 38 is in the form of a pipe which may be of about fourteend inches in diameter, and the lower end of the pipe forming the outlet is positioned in, and serves to extract clarified stock from, the downstream portion 34. The chamber 36 has an air bleed valve 39 in its top end.

It will be understood that the feed stock which contains heavy impurities enters the primary classifying chamber 36 tangentially, and as a result, a swirling or vortex flow is established within that primary classifying chamber 36. Due to the vortex flow, centrifugal forces are established that act on the heavy impurities tending to carry them to the periphery of the primary classifying chamber 36. it is thought that the heavy impurities, or trash, mentioned previously as being stones or rocks, pieces of metal or other such solids, have a weight to area ratio which makes them more susceptible to centrifugal forces rather than centripetal or frictional entrainment forces. The latter pull fibers and other solids having a more favourable, i.e. lower, weight to area ratio towards the vortex finder 38. Due to the position of the lower end of the vortex finder 38 the said centripetal or frictional forces are minimized in the upper portion 32 of primary chamber 36, allowing good separation of heavy impurities even with a high consistency stock. The lighter solids are then carried out of the centrifugal cleaner 10 along with the stock being discharged through outlet 38, which has been clarified of heavier unwanted solid impurities. It is also to be noted that the converging form or configuration of the downstream portion 34 tends to promote a more pronounced vortex flow and increase the effect of centrifugal forces on the unwanted heavy impurities. In this connection it may be noted from FIG. 3 that the face of conical section 34 cuts across the original inlet band of stock, the bottom outlet from section 34 being of smaller radius than the inner flow boundary of stock entering through inlet 30.

Where the apparatus is intended to pass, and not reject knots, it is advantageous to provide an inlet 42 in the downstream portion 34, controlled by valve 43. This inlet 42 serves to introduce liquid filtrate into the downstream portion 34, in the same direction of flow as that with which the feed stock is introduced through inlet 30. The filtrate introduced through inlet 42 dilutes the residual stock remaining after certain amounts of clarified stock have been drawn up by the central vortex flow through vortex finder 38 for discharge and further processing elsewhere in the fluid circuit 12. It is mentioned here that vortex finder 38 projects into the primary classifying zone 36 to a distance which places its inlet generally in the area of the converging downstream portion 34, say up to 50% of the depth of the cone-like downstream portion 34, and this feature makes the apparatus more efficient for high consistency stocks than would be the case if the outlet were to be positioned in the upstream portion 32.

Diluted residual stock is discharged from the downstream portion 34 through an opening 44, and that stock then passes into a secondary classifying zone indicated at 46.

The secondary classifying chamber 46 is also a two part chamber, being made up of a pair of sections 48 and 50 each in the form of a truncated cone. Section 48 is divergent in configuration, and increases rapidly in cross-sectional area from a connection with the aperture 44 to a maximum cross-sectional area defined by a plane 52. The preferred shape is that giving the most rapid increase in cross-sectional area, for example, dome-like as shown, so that the rate of increase in area is rapid near aperture 44 but comparatively slow near plane 52. From this maximum cross-sectional area at plane 52, the section 50 converges uniformly in a downstream direction, to connect with an inlet side of a reject dump valve 64. For convenience, the wall of the cone-like section 50 is disposed at about 45° to the plane 52. This is to be compared with an angular orientation of the walls of the downstream portion 34 of the primary classifying chamber 36, which are disposed at an angle of about 60° to the plane of the aperture 44.

Figure 3:
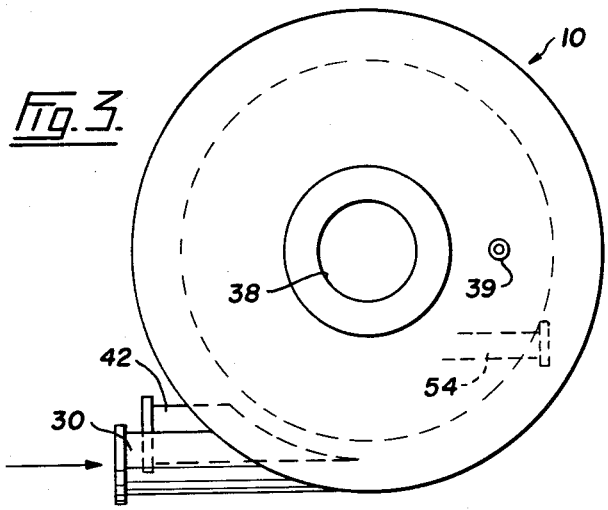
FIG. 3 is a top plan view of the apparatus of FIG. 2.

It will be seen that vortex flow of diluted residual stock received in the secondary classifying chamber 46 will tend intially to undergo expansion within the diverging section 48. Such expansion of the vortex flow will slow down that flow, thus enabling the force of gravity to become more effective in separating the unwanted heavy impurities from the diluted residual stock contained in the secondary classifying chamber 46. In accordance with one aspect of this invention, the secondary classifying chamber 46 is provided with an inlet 54 for introducing a fluid diluent into that chamber in a direction countercurrent to the rotational flow of fluid received from chamber 36. In the embodiment of FIGS. 1 to 3 the inlet 54 is located in the downstream converging section 50, and serves to introduce the fluid diluent at a flow rate and in a position and direction such as to reduce to a minimum any vortex flow in the secondary classifying chamber 46. Thus, the fluid diluent introduced at inlet 54 inhibits the formation of any vortex flow within the secondary classifying chamber 46, and thus promotes separation of the heavy impurities by gravity. Separation by gravity is also promoted by the lower consistency of the stock in chamber 46. The lower consistency in chamber 46 also ensures that the apparatus is not subject to plugging.

The heavy impurities which settle out of the diluted residual stock in the secondary chamber 46 are collected, preferably in a downstream reject chamber 60. The reject chamber 60 is connected to the secondary chamber 46 by an outlet pipe 62 and an upper reject valve 64. The outlet pipe 62 can, for example, be about ten inches in diameter, and is usually oriented with its central axis extending vertically. A lower reject valve 66 is also provided in the reject chamber 60, with the valves 64 and 66 being actuable selectively in order first, to allow for accumulation of rejected trash and heavy impurities in that chamber (with valve 64 open and valve 66 closed); and secondly, upon opening of the lower valve 66 (and closing of valve 64), to dump the impurities collected in chamber 60 for disposal elsewhere. In order to accommodate a flushing action of the reject chamber 60, there is provided a second inlet 68 introducing a flow of additional fluid diluent by means of a controlling valve 70.

The centrifugal cleaning apparatus 10 of FIGS. 1 to 3 is usually used in a fluid circuit which conducts papermaking pulp stock. Such stock is of relatively high consistency, for example, up to about 5% .A.D., and in that industry, will contain pulp fibers and may contain knot which the apparatus as described is intended not to reject.

The operating procedure is as follows:

Firstly, air bleed valve 39 is opened, and then valve 70 which allows water to flow into the unit, purging it of air. When the unit is full of water valve 39 is closed. Stock outlet valve 18 is then opened wide, and subsequently stock inlet valve 16 is fully opened. The valve 70 is then set to give an inflow of water of approximately 20 U.S.G./m. The filtrate inlet valve 54 is opened to give a flow of approximately 75 U.S.G./m. The filtrate valve 43 is initially opened to give a flow of approximately 100 U.S.G./m., and then adjusted to give a stock outlet consistency within ½% of that required for the next stage in the process. The by-pass valve 20 is then fully closed so that all stock passes through the cleaner, which then operates in the manner previously described, with a pressure differential of about 3 p.s.i. After running for about one hour, reject material is removed from reject chamber 60 by closing upper valve 64 and opening lower valve 66.

The fluid diluent introduced at 68 into the reject chamber 60 serves a number of useful purposes. The fluid diluent introduced by inlet 68 is normally clear water, and this has the effect of cooling down the contents of the reject chamber 60. That cooling or dilution water also serves to provide a backflushing effect on the pulp fiber in the reject chamber 60, moving such fibers and knots back into chamber 50. Further, the dilution water introduced by inlet 68 flows upwardly into chamber 50 and adds to the dilution of stock achieved in chamber 50, and also addes to the upward flow of fluid in this chamber which further serves to drive fibers and knots back into chamber 36 while heavy impurities still descend.

The centrifugal cleaning apparatus 10 as shown in FIGS. 1 to 3 has a number of advantages over the prior art. It operates, for instance, at a very low pressure differential, and is not susceptible to being plugged by large pieces of heavy impurities or because of dewatered stock, as with prior art cleaners. The centrifugal cleaning apparatus 10 has been operated successfully at a production capacity of about 50 to 1100 air dried tons per day for this unit.

The apparatus of FIGS. 1 to 3 is capable of being used on pulp suspensions containing knots and, with filtrate valve 43 suitably adjusted, will reject heavy impurities without rejecting the knots. However, the apparatus may also be used to reject knots; for this purpose the apparatus will be used without any flow of diluent into inlet 42. This gives a condition in which knots are rejected. Also, two of the units of this invention may be used in series; the first operating as described, and rejecting heavy trash without rejecting knots; and a second unit may be used to separate knots from the stock flowing from the first unit. The second unit would be very similar to the unit shown in FIGS. 1 to 3, but would have any inlet 42 for diluent into the primary zone. A pressure differential of around 10 p.s.i. would be maintained across this unit.

Figure 4:
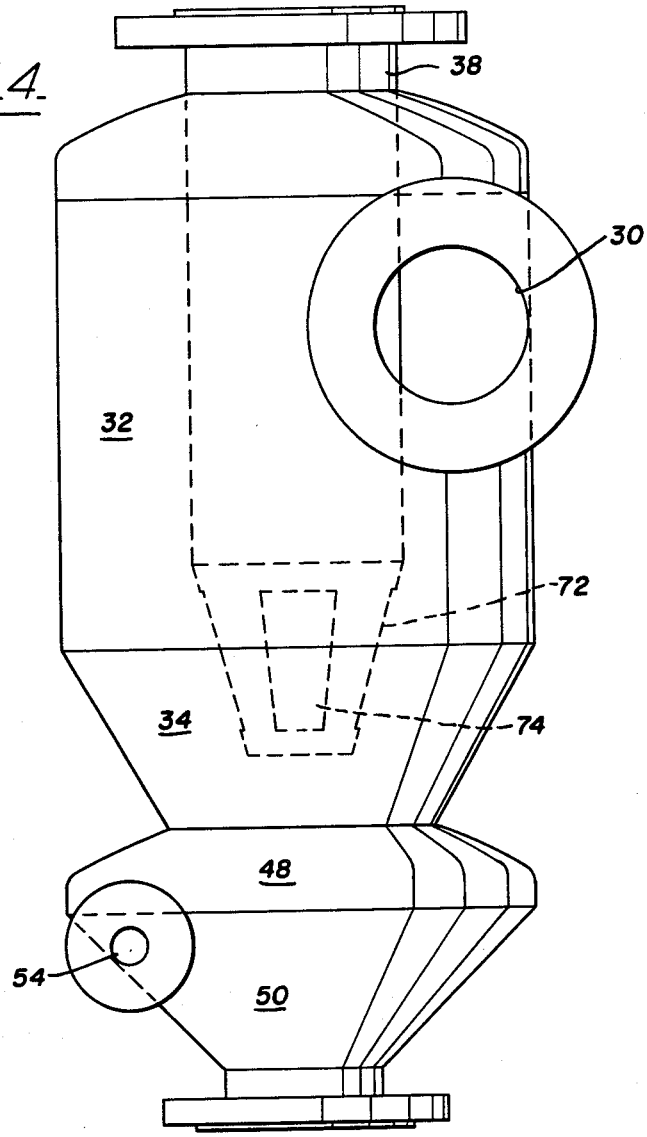
FIG. 4 is an elevation showing details of a further aspect of the present invention.
Figure 5:
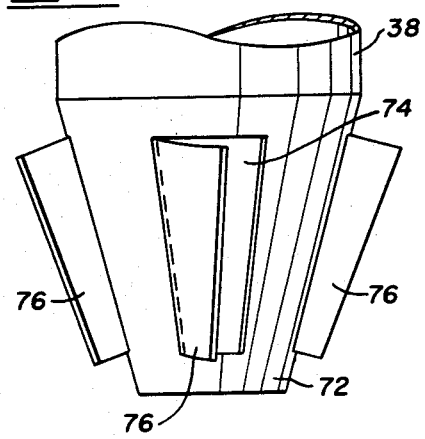
FIG. 5 is a detail of modification of the apparatus of FIG. 4.
Figure 6:
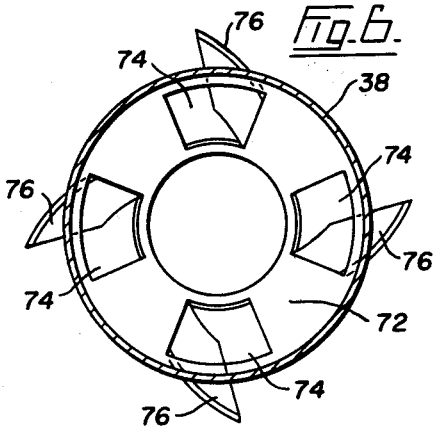
FIG. 6 is a plan view of the detail of FIG. 5.

FIGS. 4 to 6 illustrate an embodiment of the invention particularly useful in treating stock without rejecting knots. FIGS. 4 to 6 use the same reference numerals for parts already referred to in the description of FIGS. 1 to 3. However, it should be noted that FIG. 4 does not have an inlet 42 and, in particular, the central stock outlet pipe 38 has a downwardly converging conical end section 72 that commences in the upper section 32 of the primary classifying chamber 36 and has openings 74 formed in it.

As illustrated in FIG. 5 the apparatus of FIG. 4 may be modified by providing flaps 76 extending outwardly from an edge of each opening 74 across the respective opening. The preferred ways of forming these flaps is to cut out the opening 74 in the downwardly converging conical end section 72 shape it to the curved configuration illustrated in FIG. 6 and then to reweld it along an edge of the opening 74. As illustrated in FIGS. 5 and 6 particularly, typically there will be four openings equidistantly positioned around the end section 72.

The apparatus illustrated in FIGS. 4 to 6 finds particularly good application in waste paper recovery, that is in stock that does not contain knots and the like. Generally speaking the appartus of FIGS. 4 to 6 has improved performance over the apparatus of FIGS. 1 to 3 in that it is able to remove heavy objects more effeciently. However, this can be a disadvantage if it is required to leave knots in the stock. The apparatus in FIGS. 4 to 6 can be used to treat stock containing 5% solids.

Figure 7:
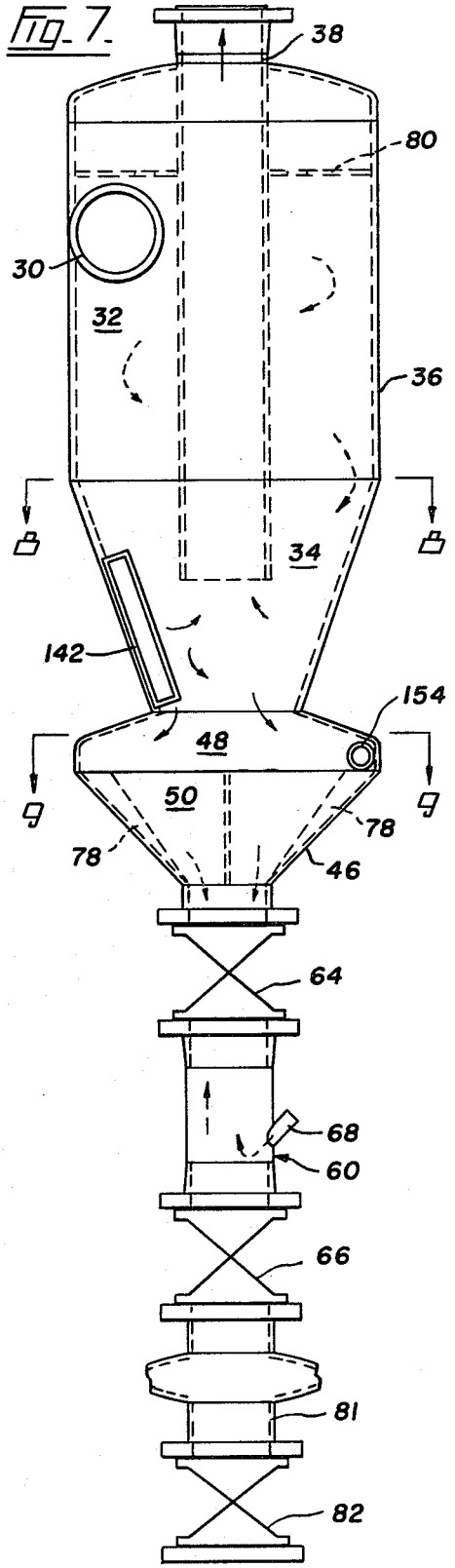
FIG. 7 is a elevation showing a further form of the apparatus of the invention.
Figure 8:
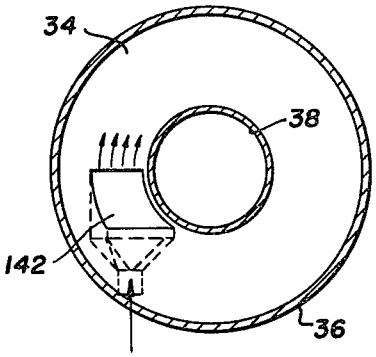
FIG. 8 is a section along the line 8--8 of FIG. 7.
Figure 9:
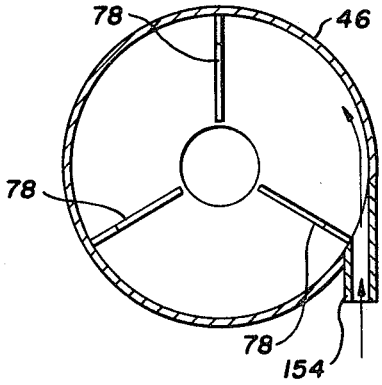
FIG. 9 is a section along the line 9—9 in FIG. 7.

A further embodiment of the invention, illustrated in FIGS. 7 to 9, has an elongated inlet 142 for the introduction of a band of lower consistency stock in the lower section 34 of the primary classifying chamber 36. The inlet 142 is elongated in the direction extending from the upper section 32 of the primary classifying chamber 36 towards the secondary classifying chamber 50. Furthermore in the apparatus of FIG. 7 an inlet 154 in the secondary classifying chamber 50 for directing a diluent tangentially into the reduce velocity stock in the secondary classifying chamber 50 is positioned in the upper section 48 of the secondary classifying chamber 50.

There are baffles 78 formed in the inclined sides of the lower conical section 50 of the secondary classifying chamber 46.

Furthermore, the apparatus of FIGS. 7 to 9 has a relatively elongated upper section 32 of the primary classifying chamber 32 in order to provide for greater dwell time for the feed stock in said upper section 32. This greater length may necessitate a support 80 for outlet 38.

There is, in the apparatus of FIGS. 7 to 9 additional to the apparatus shown in FIG. 1, a holding chamber 80 having an inlet communicating with the outlet 66 of said reject chamber 60. The holding chamber 80 has an outlet control by valve 82. In this apparatus the valves 64, 66 and 82 are interlocked in such a way that only one of the three valves can be opened at anyone time.

The apparatus illustrated in FIGS. 7 to 9 is of a particular application in the treatment of 10% consistency stock suspensions. However, the apparatus does not remove knots from the stock. The elongated upper section 32 ensures extended retention time of the stock in the upper section 32 to allow the maximum possible effects of centrifugal and centripetal forces. The provision of a band of diluent through the inlet 142 acts to minimize the shear forces acting on the track. Furthermore, the provision of baffles 78 eliminates centrifugal forces completely.

It is also desirable in this aspect of the invention that the inlet pipe 30 be of the maximum cross sectional diameter possible to prevent plugging and, in particular should be at least the same cross sectional area as the pipe leading to it. The provision of holding chamber 80 or trash extracted from the treated stock facilitates the rejection of the trash from the apparatus.

The use of the valves is as follows: In the dumping cycle the uppermost valve, valve 64, is open and valve 56 and 82 are closed. Trash accumulates in the chamber 60 typically for about 60 minutes. Valve 64 is then closed and valve 66 opened. Valve 82 remains closed. This cycle is repeated until, from experience, it is known that the holding chamber 80 is about 75% full. At this stage valve 64 is closed; and valve 66 remains closed. Valve 82 is opened and trash is discharged from the apparatus.

Valve 64, 66 and 80 are interlocked in such a way that when one valve is open the other two must be closed.

The foregoing disclosure has described preferred forms of apparatus and the process in which it is operated as embodied by this invention. It is intended within the spirit of this invention to encompass all such modifications and changes as would be apparent to a person skilled in the art, and which fall within the scope of the claims below.

I claim:

1. Apparatus for removing heavy impurities from feed stock, comprising a primary classifying chamber having an upper section of circular cross section and a downwardly-converging conical lower section, a central stock outlet pipe extending upwardly through said upper section of the primary chamber and terminating in an end in the lower section thereof spaced a substantial distance from the conical section wall, an outlet in the lower end of the lower section, an inlet pipe for directing feed stock containing heavy impurities tangentially into said chamber upper section to create a vortex flow in the primary chamber, said heavy impurities being separated outwardly by centrifugal force from feed stock being directed to said outlet pipe by centripetal force, said centripetal force being minimal in the upper section and said centrifugal force being maximal in the lower section, a secondary classifying chamber connected to the lower end of said lower conical section to receive the heavy impurities with feed stock therefrom, said secondary classifying chamber having a substantially unobstructed inlet and being formed with an upper section abruptly increasing the diameter directly from said conical lower section of the primary classifying chamber in a downward and lateral direction to a maximum cross sectional area rapidly to reduce the velocity of the vortex flow of the stock and impurities therein, said upper section of the secondary classifying chamber having a substantially greater inclination from the vertical than said conical lower section of the primary classifying chamber, said upper section of the secondary classifying chamber lying at an acute angle with respect to the conical lower section of the primary classifying chamber, and a lower conical section of the secondary classifying chamber converging from said maximum cross sectional area to an outlet controlled by a valve, and means for directing a diluent tangentially into the reduced velocity stock in the secondary classifying chamber in a direction counter to the movement of said stock further to dilute the stock to assist separation of the heavy impurities by gravity and to return lighter valuable components of the stock to the primary chamber.

2. Apparatus as claimed in claim 1 comprising a reject chamber in communication with the lower conical section of the secondary chamber through the outlet thereof when the valve of the latter outlet is open, said reject chamber having an outlet controlled by a valve, and inlet means for directing a diluent into the reject chamber near the lower end thereof to flush said reject chamber and to drive any stock fibers therein back into said lower conical section.

3. Apparatus as claimed in claim 1 in which the central stock outlet pipe has a downwardly converging conical end section, said downwardly converging end section commencing in said upper section of said primary classifying chamber; and at least one opening formed in said end section.

4. Apparatus as claimed in claim 3, including flaps extending outwardly from an edge of each opening, across the respective opening.

5. Apparatus as claimed in claim 4 in which there are four openings equidistantly positioned around said end section and in which the flaps are formed by cutting out openings in the end section, shaping the cut out portions to a substantially arcuate shape and attaching each of them at one edge to an opening.

6. Apparatus as claimed in claim 1 including an inlet for directing a diluent tangentially into said lower section of the primary chamber, said inlet being elongated in the direction extending from the upper section to said secondary classifying chamber to permit the introduction of a band of lower consistency stock into said lower section;

an inlet for directing a diluent tangentially into the reduced velocity stock in the secondary classifying chamber in a direction counter to the movement of said stock to assist separation of the heavy impurities by gravity and to return lighter valuable components of the stock to the primary chamber;

baffles formed on said lower conical section of the secondary classifying chamber.

7. Apparatus as claimed in claim 6 in which the inlet for directing diluent tangentially into the reduced velocity stock in the secondary classifying chamber directs the diluent into the upper section of said secondary classifying chamber.

8. Apparatus as claimed in claim 6 in which the upper section of circular cross section of said primary classifying chamber is relatively elongated to provide greater dwell time for the feed stock in said upper section.

9. Apparatus as claimed in claim 1 comprising a reject chamber in communication with the lower conical section of the secondary chamber through the outlet thereof when the valve of the latter outlet is open, said reject chamber having an outlet controlled by a valve, inlet means for directing a diluent into the reject chamber near the lower end thereof to flush said reject chamber and to drive any stock fibres therein back into said lower conical section, a holding chamber having an inlet communicating with said outlet of said reject chamber and having an outlet controlled by a valve.

10. Apparatus as claimed in claim 9 in which the valve controlling the outlet of the secondary classifying chamber, the valve controlling the outlet of said reject chamber and the valve controlling the outlet of said holding chamber are interlocked so that only one of the three valves can be opened at any one time.

11. Apparatus for removing heavy impurities from feed stock, comprising a primary classifying chamber having an upper section of circular cross section and a downwardly-converging conical lower section, a central stock outlet pipe extending downwardly through said upper section of the primary chamber and terminating in an end in the lower section thereof spaced a substantial distance from the conical section wall, an outlet in the lower end of the lower section, an inlet pipe for directing feed stock containing heavy impurities tangentially into said chamber upper section to create a vortex flow in the primary chamber, said heavy impurities being separated outwardly by centrifugal force from feed stock being directed to said outlet pipe by centripetal force, said centripetal force being minimal in the upper section and said centrifugal force being maximal in the lower section, an inlet controlled by a valve for directing a diluent tangentially into said lower section of the primary chamber adjacent said end of the outlet pipe and in the direction of flow of stock in said lower section, said diluent, when said valve is open, diluting and controlling the stock consistency in said primary chamber lower section and separating relatively large particles of lighter weight from the heavy impurities and directing said separated particles into the stock flowing out through the outlet pipe, a secondary classifying chamber connected to the lower end of said lower conical section to receive the heavy impurities with feed stock therefrom, said secondary classifying chamber having a substantially unobstructed inlet and being formed with an upper section abruptly increasing in diameter directly from said outlet of the conical lower section of the primary classifying chamber in a downward and lateral direction to a maximum cross sectional area rapidly to reduce the velocity of the stock and impurities therein, said upper section of the secondary classifying chamber having a substantially greater inclination from the vertical than the conical lower section of the primary classifying chamber, said upper section of the secondary classifying chamber lying at an acute angle with respect to the conical lower section of the primary classifying chamber, and a lower conical section of the secondary classifying chamber coverging from said maximum cross sectional area to an outlet controlled by a valve, and means for directing a diluent tangentially into the reduced velocity stock in the secondary classifying chamber in a direction counter to the movement of said stock further to dilute the stock to assist separation of the heavy impurities by gravity and to return lighter valuable components of the stock to the primary chamber.

12. Apparatus as claimed in claim 11 comprising a reject chamber in communication with the lower conical section of the secondary chamber through the outlet thereof when the valve of the latter outlet is open, said reject chamber having an outlet controlled by a valve, and inlet means for directing a diluent into the reject chamber near the lower end thereof to flush said reject chamber and to drive any stock fibres therein back into said lower conical section.

13. A process for separating heavy impurities from feed stock, comprising the steps of introducing feed stock tangentially into a primary zone of circular cross section to create a vortex flow in said zone and thereby effect a primary classifying action by centrifugal force on the feed stock, extracting clarified stock subjected to centripetal force in the primary zone from said primary zone centrally thereof, selectively directing a diluent into the primary zone tangentially in the direction of flow of stock therein to dilute dand control the consistency of the stock and to separate relatively large but lighter particles from the heavy impurities and directing said particles out with the clarified stock, passing residual stock containing impurities through a substantially unobstructed passage into a secondary zone with a vortex flow, rapidly stopping the vortex flow of the residual stock in the secondary zone by moving the residual stock directly from said secondary zone, across a boundary which forms an acute angle and into a chamber which diverges radially at a substantially greater rate than the vortex flow, directing diluent into the residual stock in the secondary zone in a direction counter to movement of said stock to assist further reduction of the vortex flow, and continuously passing stock with the impurities therein out of the secondary chamber and into a reject zone.

14. A process as claimed in claim 13 comprising the additional step of directing a diluent into said reject zone near a lower end thereof to flush said zone and to drive any stock fibres therein back into the secondary zone.

* * * * *